US009302157B2

(12) United States Patent
Ichikawa et al.

(10) Patent No.: US 9,302,157 B2
(45) Date of Patent: Apr. 5, 2016

(54) SOLID GOLF BALL WITH THIN MANTLE LAYER

(75) Inventors: Yasushi Ichikawa, Tualatin, OR (US); Chien-Hsin Chou, Yun-lin Hsien (TW); Chen-Tai Liu, Yun-lin Hsien (TW)

(73) Assignee: NIKE, Inc., Beaverton, OR (US)

( * ) Notice: Subject to any disclaimer, the term of this patent is extended or adjusted under 35 U.S.C. 154(b) by 693 days.

(21) Appl. No.: 12/627,992

(22) Filed: Nov. 30, 2009

(65) Prior Publication Data

US 2011/0130220 A1 Jun. 2, 2011

(51) Int. Cl.

| | |
|---|---|
| ***A63B 37/06*** | (2006.01) |
| ***A63B 37/00*** | (2006.01) |
| ***A63B 37/02*** | (2006.01) |
| ***A63B 37/12*** | (2006.01) |

(52) U.S. Cl.

CPC ..... *A63B 37/0043* (2013.01); *A63B 37/0003* (2013.01); *A63B 37/004* (2013.01); *A63B 37/006* (2013.01); *A63B 37/007* (2013.01); *A63B 37/0038* (2013.01); *A63B 37/0039* (2013.01); *A63B 37/0045* (2013.01); *A63B 37/0062* (2013.01); *A63B 37/0077* (2013.01); *A63B 37/02* (2013.01); *A63B 37/12* (2013.01); *A63B 2209/00* (2013.01)

(58) Field of Classification Search

CPC ..... A63B 37/0045; A63B 37/0059
USPC ..... 473/376, 373, 374
See application file for complete search history.

(56) References Cited

U.S. PATENT DOCUMENTS

| | | | | |
|---|---|---|---|---|
| 5,683,312 | A | 11/1997 | Boehm et al. | |
| 5,688,191 | A | 11/1997 | Cavallaro et al. | |
| 5,779,562 | A | 7/1998 | Melvin et al. | |
| 5,967,907 | A | 10/1999 | Takemura et al. | |
| 6,117,025 | A | 9/2000 | Sullivan | |
| 6,123,628 | A | 9/2000 | Ichikawa et al. | |
| 6,210,294 | B1 | 4/2001 | Wu | |
| 6,394,914 | B1 | 5/2002 | Sullivan | |
| 6,465,573 | B1 | 10/2002 | Maruko et al. | |
| 6,592,471 | B1 | 7/2003 | Watanabe et al. | |
| 6,616,551 | B2 * | 9/2003 | Nesbitt et al. | 473/376 |
| 6,648,777 | B2 | 11/2003 | Kennedy, III et al. | |
| 6,747,100 | B2 | 6/2004 | Ichikawa et al. | |

(Continued)

FOREIGN PATENT DOCUMENTS

| | | | |
|---|---|---|---|
| CN | 101124019 | A | 7/2003 |
| CN | 101485930 | A | 7/2009 |

(Continued)

OTHER PUBLICATIONS

Notification of First Office Action in Chinese Invention Application No. 201010565752.4, mailed on Mar. 20, 2012.

(Continued)

*Primary Examiner* — Raeann Gorden
(74) *Attorney, Agent, or Firm* — Honigman Miller Schwartz & Cohn LLP

(57) ABSTRACT

A solid multi-layer golf ball includes a core, a mantle layer, and a cover layer. The cover layer and the mantle layer are both made of a thermoplastic polyurethane material. The cover layer is softer than the mantle layer and provided with an optimal thickness for spin and durability. The mantle layer is relatively thin compared to the cover layer and the volume of the ball as a whole. The mantle layer is also harder than the cover layer.

8 Claims, 2 Drawing Sheets

(56) References Cited

U.S. PATENT DOCUMENTS

| | | | | |
|---|---|---|---|---|
| 6,750,299 | B2 | 6/2004 | Ichikawa et al. | |
| 6,764,415 | B2 | 7/2004 | Ichikawa et al. | |
| 6,806,323 | B2 | 10/2004 | Ichikawa et al. | |
| 6,855,073 | B1 | 2/2005 | Keller et al. | |
| 6,855,077 | B2 | 2/2005 | Tzivanis et al. | |
| 7,153,926 | B2 | 12/2006 | Isogawa et al. | |
| 7,192,368 | B2 | 3/2007 | Kennedy, III et al. | |
| 7,208,562 | B2 | 4/2007 | Kennedy, III et al. | |
| 7,524,251 | B2 | 4/2009 | Melanson et al. | |
| 2003/0013550 | A1 | 1/2003 | Moriyama et al. | |
| 2003/0176619 | A1 | 9/2003 | Keller et al. | |
| 2004/0058750 | A1 | 3/2004 | Iwami | |
| 2004/0266557 | A1 | 12/2004 | Ohama | |
| 2006/0252577 | A1 | 11/2006 | Sullivan et al. | |
| 2007/0015608 | A1 | 1/2007 | Ladd et al. | |
| 2009/0023518 | A1 | 1/2009 | Lee et al. | |
| 2009/0170634 | A1 | 7/2009 | Loper et al. | |
| 2009/0176601 | A1 | 7/2009 | Snell et al. | |
| 2009/0258731 | A1 | 10/2009 | Kamino et al. | |
| 2010/0216574 | A1 * | 8/2010 | Umezawa et al. | 473/377 |

FOREIGN PATENT DOCUMENTS

| | | | |
|---|---|---|---|
| CN | ZL201020633225.8 | | 2/2012 |
| EP | 2327456 | | 1/2013 |
| JP | 10179804 | A | 7/1998 |
| JP | 114916 | A | 1/1999 |
| JP | 2004081849 | A | 3/2004 |
| JP | 200823342 | A | 2/2008 |
| JP | 200855173 | A | 3/2008 |
| JP | 2009254471 | A | 11/2009 |

OTHER PUBLICATIONS

Notification of Grant of Patent Right for Utility Model in Chinese Utility Model Application No. 201020633225.8, mailed on Sep. 30, 2011 (issued Utility Model patent cited above as ZL201020633225.8, which is a corresponding Chinese case to the present application).

European Search Report and Written Opinion in European Application No. EP10192951.1, mailed on Mar. 16, 2011.

Communication under Rule 71(3) EPC for European Application No. EP10192951.1, mailed on Jul. 26, 2012.

Office Action for Chinese Invention Patent Application No. 201010565752.4 mailed on Nov. 22, 2012.

Office Action for Japanese Patent Application No. 2010-265922 mailed on Sep. 4, 2012.

Office Action dated Dec. 1, 2015 in Japanese Patent Application No. 2010-265922.

* cited by examiner

SOLID GOLF BALL WITH THIN MANTLE LAYER

The present invention relates generally to a golf ball with multiple layers and particularly to a solid golf ball having a mantle layer which is thin and hard compared to a surrounding cover layer.

Golf balls have undergone significant changes over the years. For example, rubber cores have gradually replaced wound cores because of consistent quality and performance benefits such as reducing of driver spin for longer distance. Other significant changes have also occurred in the cover and dimple patterns on the golf ball.

The design and technology of golf balls has advanced to the point that the United States Golf Association ("USGA) has instituted a rule prohibiting the use of any golf ball in a USGA-sanctioned event that can achieve an initial velocity of 250 ft/s, when struck by a driver having a velocity of 130 ft/s (referred to hereafter as "the USGA test".) (The Royal and Ancient Club St. Andrews ("R&A") has instituted a similar rule for R&A-sanctioned events.) Manufacturers place a great deal of emphasis on producing golf balls that consistently achieve the highest possible velocity in the USGA test without exceeding the limit. Even so, golf balls are available with a range of different properties and characteristics, such as velocity, spin, and compression. Thus, a variety of different balls may be available to meet the needs and desires of a wide range of golfers.

Regardless of construction, many players often seek a golf ball that delivers maximum distance. Balls of this nature obviously require a high initial velocity upon impact. As a result, golf ball manufacturers are continually searching for new ways in which to provide golf balls that deliver the maximum performance for golfers at all skill levels, and seek to discover compositions that allow a lower compression ball to provide the performance generally associated with a high compression ball.

Balls having a solid construction are generally most popular with the average recreational golfer because they provide a very durable ball while also providing maximum distance. Solid balls may comprise a single solid core, often made of cross-linked rubber such as polybutadiene which may be chemically cross-linked with zinc diacrylate and/or similar cross-linking agents, and then encased within a cover material, such as SURLYN® (the trademark for an ionomer resin produced by DuPont) to provide, a tough, cut-proof blended cover, often referred to as a "two-piece" golf ball.

Such a combination a single solid core and a cut-proof cover may impart a high initial velocity to such two-piece golf balls that results in improved distance. But the materials used in such two-piece golf balls may be very rigid. As a result, two-piece balls may, depending upon the construction, have a hard "feel" when struck with a club. Likewise, due to their hardness, these two-piece balls may have a relatively low spin rate, which, while providing greater distance, may sometimes be more difficult to control, for example, when hitting an approach shot to the green.

SUMMARY

In a first aspect, the invention provides a golf ball having multiple layers comprising a core, a cover layer surrounding the core, the cover layer having a cover hardness, and a mantle layer positioned between the core and the cover layer, the mantle layer having a mantle hardness. The cover hardness is at least 6 Shore D units less than the mantle hardness. The golf ball has a total volume that is a combined volume of all of the layers of the golf ball, and wherein the mantle layer has a mantle volume that is the volume of only the mantle layer, and wherein the mantle volume is less than ten percent of the total volume.

In a second aspect, the invention provides a golf ball comprising an inner core, an outer core surrounding the inner core, a mantle layer surrounding the outer core, wherein the mantle layer comprises thermoplastic polyurethane, and wherein the mantle layer has a mantle thickness and a mantle hardness, and a cover layer surrounding the mantle layer. The cover layer comprises thermoplastic polyurethane, and the cover layer has a cover thickness and a cover hardness. The mantle thickness is at least 0.4 mm less than the cover thickness; and the mantle hardness is at least about 4 Shore D units greater than the cover hardness.

In a third aspect, the invention provides a golf ball comprising an inner core comprising a highly neutralized polymer, the inner core having a diameter of about 24-28 mm. The golf ball also has an outer core layer surrounding the inner core, the outer core comprising polybutadiene rubber, the outer core having an outer core thickness of about 7.55-7.75 mm. The golf ball also has a mantle layer surrounding the outer core, wherein the mantle layer comprises thermoplastic polyurethane. The mantle layer has a mantle thickness of about 0.6 mm and a mantle hardness of between about 62 and about 70 on the Shore D scale. The golf ball also has a cover layer surrounding the mantle layer, wherein the cover layer comprises thermoplastic polyurethane, and wherein the cover layer has a cover thickness of about 1.0-1.2 mm and a cover hardness of between about 45 and about 58 on the Shore D scale. The golf ball has a compression of between about 2.4 and about 2.7 when subjected to an initial load of 10 kg and a final load of about 130 kg.

Other changes, modifications, features, benefits, and advantages of the aspects of the invention will be, or will become, apparent to one of ordinary skill in the art upon examination of the following figures and detailed description. It is intended that all such changes, modifications, features, benefits, and advantages be included within this description and this summary, be within the scope of the invention, and be protected, as defined by the appended claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
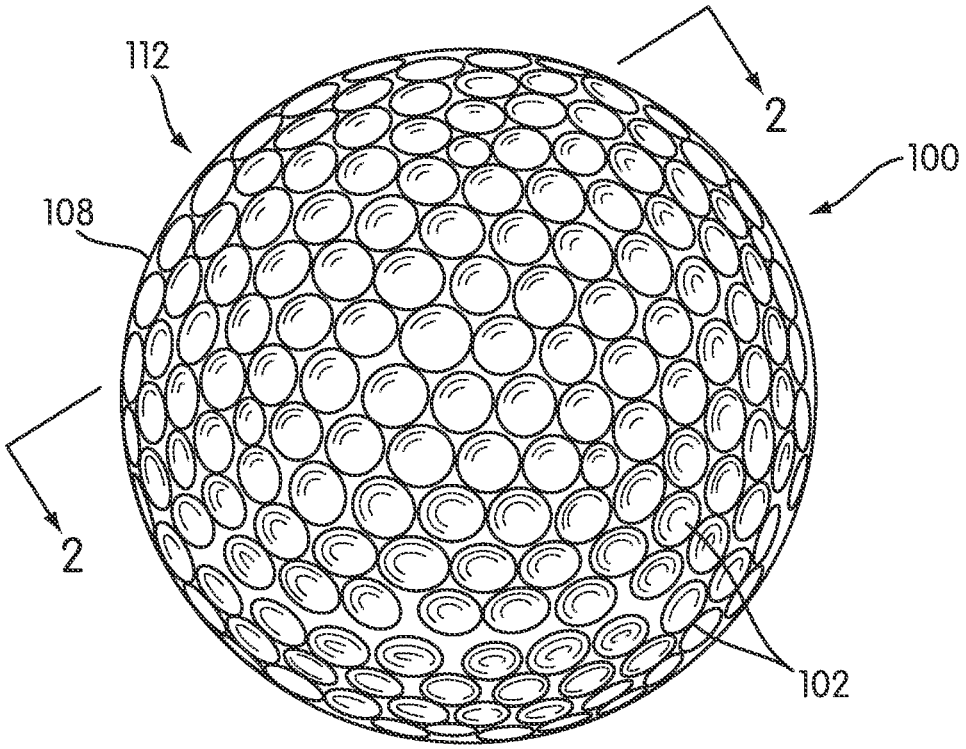
FIG. 1 is a perspective view of a golf ball.

More recently, multi-layer golf balls have been made with layers of thermoplastic material such as ionomer materials. In such multi-layer balls, thinner layers of different materials may be fused together to add additional features such as lower spin for tee shots, but with increased spin for approach shots to the green. For example, one of the layers may be a hard ionomer resin in a mantle layer while a softer elastomer material forms the layer adjacent the outer cover. Thinner layers of ionomer resin may be used because the ionomer resin may have a relatively lower resilience, particularly when compared to elastomer materials that may be used to form the core, or various portions of the core.

Golf ball layers made of a thermoplastic material may also be more consistent in quality than, for example, a thermoset elastomeric rubber core, such as cross-linked polybutadiene. Similarly, more elastic thermoplastic materials, such as thermoplastic polyurethane (TPU) may be used in place of harder, less elastic cross-linked ionomer resins (e.g., SURLYN®) in the layers of the golf ball to achieve a softer feel which is more conducive to imparting spin to the golf ball and thus control in flight and on landing. Further, as disclosed herein, TPU can be used in combination with/adjacent to softer and/or harder materials to finely tune the response of the golf ball when struck.

Definitions

It is advantageous to define several terms before describing the invention. It should be appreciated that the following definitions are used throughout this application.

Where the definition of terms departs from the commonly used meaning of the term, applicant intends to utilize the definitions provided below, unless specifically indicated.

For the purposes of this disclosure, the term "golf ball" refers to any generally spherically shaped ball which may be used in playing the game of golf.

For the purposes of this disclosure, the term "core" normally refers to those portions of a golf ball which are closer to or proximate the center of the golf ball. The core may have multiple layers, where the centermost portion of the golf ball is the "core" or "inner core" and any surrounding core layers are "outer core" layers.

For the purposes of this disclosure, the term "mantle" generally refers to an optional layer or layers of a golf ball which may be positioned between the core layer or layers and the outermost cover, and which may be proximate or adjacent to the cover.

For the purposes of this disclosure, the term "cover" generally refers to the outermost layer of a golf ball, which often has a pattern of dimples (dimple pattern) on the outer surface thereof.

For the purposes of this disclosure, the term "dimple" refers to an indentation in or a protrusion from the outer surface of a golf ball cover that is used to control the flight of the golf ball. Dimples may be hemispherical (i.e., half of a sphere) or semi-hemispherical (i.e., a part or portion of a hemisphere) in shape, including various combinations of hemispherical and semi-hemispherical dimples, but may also be elliptical-shaped, square-shaped, polygonal-shaped, such as hexagonal-shaped, etc. Dimples which are more semi-hemispherical in shape may be referred to as being "shallower" dimples, while dimples which are more hemispherical in shape may be referred to as being "deeper" dimples.

For the purposes of this disclosure, the term "dimple pattern" refers to an arrangement of a plurality of dimples on the outer surface of the cover of a golf ball. The dimple pattern may comprise dimples having the same shape, different shapes, different arrangements of dimples within the pattern (both as to shape and/or size), repeating subpatterns (i.e. a smaller pattern of dimples arranged within the dimple pattern), such as spherical triangular, etc. In some embodiments, the total number of dimples in the dimple pattern may be in the range of from about 250 to about 500, for example, from about 300 to about 400. The total number dimples in the dimple pattern is often an even number (e.g., 336 or 384 dimples), but may also be an odd number (e.g., 333 dimples).

For the purposes of this disclosure, the term "total dimple volume" refers to the aggregate, total, combined, etc., volume of all dimples comprising the dimple pattern.

For the purposes of this disclosure, the term "thermoplastic" refers to the conventional meaning of the term thermoplastic, i.e., a composition, compound, material, medium, substance, etc., which exhibits the property of a material, such as a high polymer, that softens when exposed to heat and generally returns to its original condition when cooled to room temperature (e.g., at from about 20° to about 25° C.)

For the purposes of this disclosure, the term "thermoset" refers to the conventional meaning of the term thermoset, i.e., a composition, compound, material, medium, substance, etc., that is cross-linked such that it does not have a melting temperature, and cannot be dissolved in a solvent, but which may be swelled by a solvent.

For the purposes of this disclosure, the term "polymer" refers to a molecule having more than 30 monomer units, and which may be formed or result from the polymerization of one or more monomers or oligomers.

For the purposes of this disclosure, the term "oligomer" refers to a molecule having 2 to 30 monomer units.

For the purposes of this disclosure, the term "monomer" refers to a molecule having one or more functional groups and which is capable of forming an oligomer and/or polymer.

For the purposes of this disclosure, the term "ionomer" refers to a monomer having at least one carboxylic acid group, and which may be at least partially or completely neutralized by one or more bases (including mixtures of bases) to provide carboxylic acid salt monomers (or mixtures of carboxylic acid salt monomers). For example, the ionomer may comprise a mixture of carboxylic acid sodium and zinc salts monomers, such as the mixed ionomer used in making the ionomer resin sold under DuPont's trademark SURLYN® for cut-resistant golf ball covers.

For the purposes of this disclosure, the term "ionomer resin" refers to an oligomer or polymer which may comprise, or be formed, from one or more ionomer units or ionomers, and which may be a copolymer of one or more ionomers (such as methacrylic acid which is at least partially or completely neutralized) and one or more monomers or oligomers which is not an ionomer, such as, for example, ethylene.

For the purposes of this disclosure, the term highly neutralized polymer refers to polymers whose charge has been mostly countered by the addition of a counter-ion material. Highly neutralized polymers may have a charge dissipation of 95% or greater.

For the purposes of this disclosure, the term "elastomer" refers to oligomers or polymers having the property of elasticity, and may be used interchangeably with the term "rubber" herein.

For the purposes of this disclosure, the term "polyisocyanate" refers to an organic molecule having two or more isocyanate functional groups (e.g., a diisocyanate). Polyisocyanates useful herein may be aliphatic or aromatic, or a combination of aromatic and aliphatic, and may include, but are not limited to, diphenyl methane diisocyanate (MDI), toluene diisocyanate (TDI), hexamethylene diisocyanate (HDI), dicyclohexylmethane diisocyanate ($H_{12}$MDI), isoprene diisocyanate (IPDI), etc.

For the purposes of this disclosure, the term "polyol" refers to an organic molecule having two or more hydroxy functional groups. The term "polyol" may include diols, triols, etc., polyester polyols, polyether polyols, polycarbonate diols, etc. For example, these other polyols may include "bio-renewable" polyether polyols (i.e., those polyether polyols which have reduced impact on the environment during processing) such as one or more of polytrimethylene ether glycol, polytetramethylene ether glycol (PTMEG), etc., which have, for example, a hydroxyl value of 11.22 to 224.11 mg KOH/g. These "bio-renewable" polyether polyols, such as polytrimethylene ether glycols, may be derived, obtained, extracted, etc., from bio-renewable resources, such as through a fermentation process of natural corn, rather by a synthetic chemical process.

For the purposes of this disclosure, the term "polyurethane" refers to a polymer which is joined by urethane (carbamate) links, and which may be prepared, for example, from polyols (or compounds forming polyols such as by ring-opening mechanisms, e.g., epoxides) and polyisocyanates. Polyurethanes useful herein may be thermoplastic or thermosetting, but are thermoplastic when used in the cover. The soft segment of a thermoplastic polyurethane may also be partially cross-linked with other polyols or materials to achieve varying properties or characteristics, such as to manipulate the hardness, etc.

For the purposes of this disclosure, the term "chain extender" refers to an agent which increases the molecular weight of a lower molecular weight polyurethane to a higher molecular polyurethane. Chain extenders may include one or more diols such as ethylene glycol, diethylene glycol, butane diol, hexane diol, etc.; triols such as trimethylol propane, glycerol, etc.; and polytetramethylene ether glycol, etc.

For the purposes of this disclosure, the term "rebound resilience" refers to the material property of rubber or materials formulated to have rubber-like properties, where the rebound resilience is an indication of the hysteretic energy loss that may also be defined by the relationship between the storage modulus of the material and the loss modulus of the material. Rebound resilience is generally expressed as a percentage, where the percentage is inversely proportional to the hysteretic loss. For materials alone, the rebound resilience may be measured using any known method, such as ASTM D7121-05 standard protocol. Rebound resilience of the golf ball system may be measured by the coefficient of restitution (COR) of the material used in a component of the golf ball, by the COR of a separate portion(s) or a separate component(s) of a golf ball (e.g., cores, layers, cover, etc.), or by the COR of the golf ball.

For the purposes of this disclosure, the term "moment of inertia (MOI)" refers to a measure of an object's resistance to changes in its rotation rate, and may be given in units of $gcm^2$. The term MOI also refers interchangeably to the terms "mass moment of inertia" and "angular mass."

For the purposes of this disclosure, the term "coefficient of restitution (COR)" refers to the ratio of velocity of an object before and after an impact. A COR of 1 represents a perfect elastic collision where no energy is lost due to the collision, while a COR of 0 represents a perfect inelastic collision, where all of the energy is dissipated during the collision.

For the purposes of this disclosure, the term "specific gravity (SG)" refers to the conventional meaning of the ratio of the density of a given solid (or liquid) to the density of water at a specific temperature and pressure.

For the purposes of this disclosure, the term "deflection" refers to the degree to which a structural element is displaced under load. The amount of deflection (deflection amount) may be used as a measure of the ability to compress the golf ball (or a component or components of the golf ball), and thus is a measure of the rebound resilience (i.e., COR).

For the purposes of this disclosure, the term "Shore D hardness" refers to a measure of the hardness of a material by a durometer, and especially the material's resistance to indentation. Shore D hardness may be measured with a durometer directly on the curved surface of the core, layer, cover, etc., according to ASTM method D2240. In other embodiments, the hardness may be measured using standard plaques.

For the purposes of this disclosure, the term "curved surface" refers to that portion of the surface of a golf ball, core layer or layers, core, cover, etc., which is curved and which is used for measuring various properties, characteristics, etc., of the golf ball, core layer or layers, core, cover, etc.

Flying distance may be used as an index to evaluate the performance of a golf ball. Flying distance is affected by three primary factors: "initial velocity", "spin rate", and "launch angle". Initial velocity is one of the primary physical properties affecting the flying distance of the golf ball. The coefficient of restitution (COR) may also be used as an alternate parameter for the initial velocity of the golf ball.

Another index which may be used to measure the performance of a golf ball is spin rate. The spin rate of a ball may be measured in terms of "back spin" and "side spin," as these different types of spin have different impacts on the flight of the ball. The spin of the ball against the direction of flight is known as "back spin". Any spin to the ball that is oriented at an angle to the direction of flight is "side spin". Back spin generally affects the distance of the ball's flight. Side spin generally affects the direction of the ball's flight path. The vector addition of back spin and side spin is the "total spin".

The spin rate of the golf ball generally refers to the speed that the ball turns about a longitudinal axis through the center of the ball. The spin rate of the ball is often measured in revolutions per minute. Because the spin of the ball generates lift, the spin rate of the ball directly impacts the trajectory of the ball. A shot with a higher spin rate tends to fly to a higher altitude compared to a ball with a lower spin rate. Because the ball tends to fly higher with a higher spin rate, the overall distance traveled by a ball hit with an excessive amount of spin tends to be less than that of a ball hit with an ideal amount of spin. Conversely, a ball hit with an insufficient amount of spin may not generate enough lift to increase the carry distance, thus resulting in a significant loss of distance. Therefore, hitting a ball with the ideal amount of spin may maximize the distance traveled by the ball.

Description

FIG. 1 is a perspective view of a solid golf ball 100 according to an embodiment of the invention. Golf ball 100 may be generally spherical in shape with a plurality of dimples 102 arranged on the outer surface 108 of golf ball 100 in a pattern 112.

Internally, golf ball 100 may be generally constructed as a multilayer solid golf ball, having any desired number of pieces. In other words, multiple layers of material may be fused, blended, or compressed together to form the ball. The physical characteristics of a golf ball may be determined by the combined properties of the core layer(s), any optional mantle layers, and the cover. The physical characteristics of each of these components may be determined by their respective chemical compositions. The majority of components in golf balls comprise oligomers or polymers. The physical properties of oligomers and polymers may be highly dependent on their composition, including the monomer units included, molecular weight, degree of cross-linking, etc. Examples of such properties may include solubility, viscosity, specific gravity (SG), elasticity, hardness (e.g., as measured as Shore D hardness), rebound resilience, scuff resistance, etc. The physical properties of the oligomers and polymers used may also affect the industrial processes used to make the components of the golf ball. For example, where injection molding is the processing method used, extremely viscous materials may slow down the process and thus viscosity may become a limiting step of production.

Figure 2:
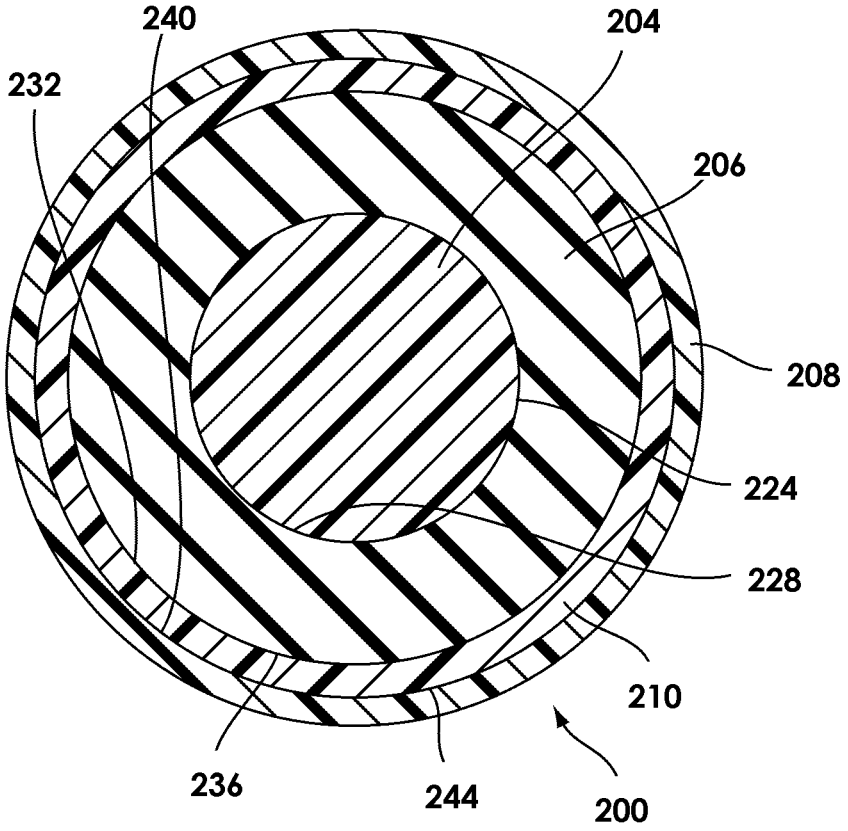
FIG. 2 is a sectional view of an embodiment of a golf ball taken along line 2-2 of FIG. 1.

As shown in FIG. 2, one embodiment of such a golf ball (referred to generally as 200) includes an inner core 204, an outer core 206 adjacent to, surrounding, and abutting inner core 204, a mantle layer 210 adjacent to, surrounding, and abutting outer core 206, and a cover 208 adjacent to, surrounding, and abutting mantle layer 210.

Cover 208 surrounds, encloses, encompasses, etc., the core and any other internal layers of the ball. Cover 208 has an outer surface that may include a dimple pattern comprising a plurality of dimples. Though cover 208 may be made of any conventional golf ball cover material, such as an ionomer such as Surlyn®, cover 208 is made in some embodiments from a thermoplastic polyurethane (TPU). Cover 208 has a relatively higher SG greater than that of the core, such as, in some embodiments, at least about 1.2. Cover 208 can have any thickness, but may, in some embodiments, have a thickness ranging from about 0.5 to about 2 mm, and, in some embodiments from about 1.0 to about 1.5 mm. In some embodiments, the thickness of cover 208 is about 1.2 mm.

Mantle layer 210 abuts cover 208. Though referred to herein as "mantle layer", some of those in the art may refer to mantle layer 210 by other names, such as "inner cover layer", an "outer core layer", or the like. Regardless of the naming convention used, any layer positioned next to the outer cover, such as cover 208, may be considered mantle layer 210.

Mantle layer 210 is generally thinner and harder than cover 208. The thickness of mantle layer 210 may be any thickness less than that of cover 208. In some embodiments, the thickness of mantle layer 210 is generally less than 1.0 mm. In some embodiments, the thickness of mantle layer 210 is about 0.6 mm. In some embodiments, the thickness of mantle layer 210 is approximately half of the thickness of cover 208. In some embodiments, the thickness of mantle layer 210 is at least 0.6 mm less than the thickness of cover 208.

Mantle layer 210 is, in some embodiments, the thinnest layer in golf ball 200. One way to characterize the size of mantle layer 210 is by the volume of the layer as a percentage of the total volume of golf ball 200. The total volume of golf ball 200 may be considered to be the sum of the volumes of each of the layers of golf ball 200. For example, because golf ball 200 comprises core 204, outer core 206, mantle layer 210, and cover 208, the total volume of golf ball 200 is the sum of the inner core volume, the outer core volume, the mantle layer volume, and the cover volume. Because each layer of golf ball is spherical or a portion of a spherical body, the volume of any layer can be calculated as the volume of a sphere having a diameter of the thickness of the layer or a portion of a sphere volume having a height of the thickness of the layer.

In all embodiments of golf ball 200, mantle layer 210 has a volume which is 10 percent or less of the total volume of golf ball 200. In some embodiments where the thickness of mantle layer 210 is about 0.8 mm, mantle layer 210 has a volume which is about 9.8 percent of the total volume of golf ball 200. In some embodiments where the thickness of mantle layer 210 is about 0.6 mm, mantle layer 210 has a volume which is about 7.44 percent of the total volume of golf ball 200.

In some embodiments, mantle layer 210 has a higher hardness than cover 208. In some embodiments, mantle layer 210 may have a Shore D hardness of greater than about 60 while the outer cover layer 208 may have a Shore D hardness of less than about 60. In some embodiments, mantle layer 210 may have a hardness of between about 62-70, while outer cover layer 208 may have a Shore D hardness of from about 45-58 as measured on the ball. In some embodiments, the hardness difference between mantle layer 210 and cover 208 may be at least about 4 Shore D units, where mantle layer 210 is harder than cover 208. It is anticipated that providing a softer cover 208 and a relatively hard mantle layer 210 reduces the spin off of driver shots due to the hard mantle layer 210 while allowing iron shots to attain high or desired spin rates due to the soft cover 208.

In these embodiments, mantle layer 210 and cover 208 may have a similar specific gravity. In some embodiments, the specific gravity of mantle layer 210 and cover 208 may be about 1.2.

In one embodiment of golf ball 200, to achieve a desired spin reduction off driver shots while maintaining desired spin rates on iron shots, the inner core diameter is about 28 mm with a volume of 11,494 mm^3, the outer core thickness is about 7.5 mm to about 7.75 mm with a volume of about 30,135 mm^3, the mantle thickness is about 0.6 mm with a volume of about 3583 mm^3, and the cover layer thickness is about 1.2 mm with a volume of about 7,772 mm^3. In this embodiment, the volume of mantle layer is about 6.8 percent of the total volume of golf ball 200. If the hardness of mantle layer 210 is at least 4 Shore D hardness units greater than the hardness of cover 208, then the desired spin properties are believed to be achieved.

Golf ball 100 may include other features. For example, any number of dimples 102 may be provided on surface 108 of golf ball 100. In some embodiments, the number of dimples 102 may be in the range from about 250 to about 500. In other embodiments, the number of dimples 102 may be in the range from about 300 to about 400. As shown in FIG. 1, dimples 102 may be arranged on surface 108 of golf ball 100 in a triangular spherical pattern 112, as well as any other dimple patterns known to those skilled in the art.

Though shown as substantially hemispherical, dimples 102 may have any shape known in the art, such as semi-hemispherical, elliptical, polygonal, such as hexagonal, etc. While in some embodiments dimples 102 may be protrusions extending outwardly from surface 108 of golf ball 100, dimples 102 normally comprise indentations in surface 108 of golf ball 100. Each indentation of each dimple 102 defines a dimple volume. For example, if dimple 112 is a hemispherical indentation in surface 108, the space carved out by dimple 112 and bounded by an imaginary line representing where surface 108 of golf ball 100 would be if no dimple 102 were present has a dimple volume of a hemisphere, or $\frac{2}{3}\pi r^3$, where r is the radius of the hemisphere. In some embodiments, all dimples 102 may have the same or similar diameter or radius. In other embodiments, dimples 102 may be provided with different diameters or radii. In some embodiments, each dimple 102 may have a diameter or radius selected from a preselected group of diameters/radii. In other embodiments, the number of different diameters/radii in the preselected group of diameters/radii may be in the range of from three (3) to six (6). In some embodiments, the number of dimples 102 with the largest diameter/radius may be greater than the number of dimples with any other diameter/radius. In other words, in such an embodiment, there are more of the largest dimples than dimples of any other size. Dimples 102 may also be arranged in repeating subpatterns of dimples 102 which may have recognized geometries (e.g., pentagonal), and may comprise combinations of dimples having smaller and larger diameters/radii.

The aggregate of the volumes of all of dimples 102 on 108 surface of golf ball 100 may be referred to as a "total dimple volume." In one embodiment, the total dimple volume may be in the range of from about 550 to about 800 $mm^3$. In some embodiments, the total dimple volume may in the range of from about 600 to about 800 $mm^3$.

Inner core 204 may comprise any number of materials. In some embodiments, inner core 204 may comprise a thermoplastic material or a thermoset material. The thermoplastic material of inner core 204 may be an ionomer resin, a bimodal ionomer resin, a polyamide resin, a polyester resin, a polyurethane resin, etc., and combinations thereof. In one embodiment, inner core 204 may be formed from an ionomer resin. For example, inner core 204 may be made from a highly neutralized ionomer resin such as HPF or SURLYN®, both commercially available from E. I. Dupont de Nemours and Company, and IOTEK®, which is commercially available from Exxon Corporation. To increase COR, one composition of inner core 204 may include HPF as the main ionomer resin composition with SURLYN® and/or IOTEK® as optional sub-compositions. Any sub-composition of inner core 204 may be in an amount of from 0 to about 10 parts by weight, based on 100 parts by weight of the main ionomer resin composition of inner core 204.

Inner core 204 may be made using any method known in the art, such as hot-press molding, injection molding, compression molding, etc. Inner core 204 may comprise a single layer or multilayer construction, and except for the aforementioned materials, other materials may also be optionally included in inner core 204. In some embodiments, the material of inner core 204 may be selected to provide inner core 204 with a COR greater than about 0.750. In some embodiments, inner core 204 may have a COR at 40 meters per second ranging between about 0.79 and about 0.89. In some embodiments, inner core 204 may have a higher COR than that of golf ball 100 taken as a whole.

In some embodiments, inner core 204 may have a diameter, indicted in FIG. 2 by dashed double-headed arrow 220, in a range between about 19 mm and about 37 mm. In some embodiments, diameter 220 of inner core 204 may be in the range from about 19 mm and about 32 mm. In some embodiments, diameter 220 of inner core 204 may be in the range between about 21 mm and about 35 mm. In some embodiments, diameter 220 of inner core 204 may range between about 23 mm and 32 mm.

In the embodiment shown in FIG. 2, outer core 206 surrounds, covers, encompasses, substantially encloses, etc., inner core 204. Outer core 206 has an interior surface 224 facing an exterior surface 228 of inner core 204. In the embodiment shown in FIG. 2, exterior surface 232 of outer core 206 faces an interior surface 236 of cover 208. Outer core 206 may have any thickness. In one embodiment, the thickness of outer core 206 may be in the range of from about 3 to about 7.75 mm. In one embodiment, the thickness of outer core 206 may in the range of from about 4 to about 10 mm. Outer core 206 may be formed using any method known in the art, such as compression molding, injection molding, or the like.

Outer core 206 may comprise a thermoset material. In some embodiments, the thermoset material may be a rubber composition. In some embodiments, the base rubber of the rubber composition may include 1,4-cis-polybutadiene, polyisoprene, styrene-butadiene copolymers, natural rubber, and combinations thereof, as well as rubber compositions that have been at least partially cross-linked (e.g., by vulcanization). To increase the resiliency of the core layer or layers, 1,4-cis-polybutadiene may be used as the base rubber of the rubber composition. Alternatively, 1,4-cis-polybutadiene may be used as the base material for outer core 206, with additional materials being added to this base material. In some embodiments, the amount of 1,4-cis-polybutadiene may be at least 50 parts by weight, based on 100 parts by weight of the rubber composition. 1,4-cis-polybutadiene used here can be ultra high cis type with cis content of over 96%. Neodymium (Nd) catalyst is often be used for this type of polybutadiene and normally has Raw Mooney Viscosity (ML1+4 100 deg C.) of 40-60.

Additives, such as a cross-linking agent, a filler with a greater specific gravity, plasticizers, anti-oxidants, etc., may be added to the rubber composition. Suitable cross-linking agents may include peroxides, zinc acrylate, magnesium acrylate, zinc methacrylate, magnesium methacrylate, etc., as well as combinations thereof. To increase the resiliency of the rubber composition, zinc acrylate may be used. However, to increase the resistance to long-term exposure to relatively high ambient temperatures, a peroxide may be used as the cross-linking agent. In particular, when inner core 204 is formed from a highly resilient thermoplastic material, the performance of golf ball 100 is maintained in spite of long-term exposure to relatively high ambient temperatures when outer core 206 is formed from a peroxide cross-linked polybutadiene material.

To increase the specific gravity of outer core 206, a suitable filler may be added in the rubber composition, such as zinc oxide, barium sulfate, calcium carbonate, magnesium carbonate, etc. In addition, a metal powder with a greater specific gravity may also be used as the filler, such as tungsten. By means of adjusting the added amount of the filler, the specific gravity of outer core 206 may be adjusted as desired.

Table 1 shows two specific examples of golf balls according to embodiments of the invention, Ball 1 and Ball 2. In these examples, the mantle is made from a TPU material having a molecular weight of about 2000 grams/mol. The cores include outer rubber layers with resin centers made from HPF2000® at 85 percent by weight and AD1035 at 15 percent by weight, where the resin(s) is/are doped with BaSO4. HPF2000 and AD1035 are thermoplastic resins that may include any and/or all of the following in varying compositions: salts of ethylene/methylacrylic acid/butylacrylic acid random terpolymers (e.g., Surlyn®), magnesium stearate, and combinations of terpolymers of butylene/polyalkylene ether/phthalic acid diester (e.g., Hytrel®) and ZnO. HPF2000 and AD1035 are both available from E.I. DuPont de Nemours & Co. The cover is made from one of two TPU materials, TPU 1 and TPU 2.

TABLE 1

Examples of Ball Structures with Thin, Hard TPU Mantles

| | | Ball 1 | Ball 2 |
|---|---|---|---|
| Center | Dia (mm) | 24 | 24 |
| | HPF2000 | 85 | 85 |
| | AD1035 | 15 | 15 |
| | BaSO4 | Yes | Yes |
| Outer rubber | Hd | D56 | D56 |
| Mantle | Thickness (mm) | 0.6 | 0.6 |
| | Hd | D65 | D65 |
| Cover | Thickness (mm) | 1.2 | 1.2 |
| | TPU 1 | X | |
| | TPU 2 | | X |

As is discussed throughout this description, solid golf balls may be made using any method known in the art. In some embodiments, the core layer or layers (inner core or first core layer, outer core or second core layer) is typically formed first, such as by compression molding or injection molding the core layer(s). The material may be cured, if necessary, using any method known in the art, such as in an oven or with UV light. The finished core layer(s) may be subjected to grinding, scoring, or other processes to prepare the core layer (s) to bond with the subsequent layers, even if no adhesive is used between the layers, though, in some embodiments, any known adhesive material may be used to secure adjacent layers together.

Any optional mantle layers are then formed to surround or substantially surround the core layer(s), such as by injection molding, overmolding, or compression molding the mantle layer(s) material. The material may be cured, if necessary, using any method known in the art, such as in an oven or with UV light. The finished mantle layer(s) may be subjected to grinding, scoring, or other processes to prepare the mantle layer(s) to bond with the subsequent layers, even if no adhesive is used between the layers, though, in some embodiments, any known adhesive material may be used to secure adjacent layers together.

Any cover layers (inner cover or outer cover layer) are then formed to substantially surround the core layer(s) and any optional mantle layer(s), such as by injection molding, overmolding, or compression molding the cover layer(s). The material may be cured, if necessary, using any method known in the art, such as in an oven or with UV light. The finished cover layer(s) may be subjected to grinding, scoring, or other processes to prepare the cover layer(s) to bond with the subsequent layers, even if no adhesive is used between the layers, though, in some embodiments, any known adhesive material may be used to secure adjacent layers together. The finished cover layer(s) may also be subjected to these processes to provide a more aesthetically pleasing appearance.

Finally, any coating layers are applied to the finished cover layer. Coating layers may include paint layers, protective coatings, indicia, or the like. The coating layers may be applied using any known technique, such as by spraying, dipping, printing such as pad printing and ink jet printing, painting, or the like. The coating layers are then cured, such as in an oven or with UV light.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A golf ball having multiple layers comprising:

a core, wherein the core comprises an inner core comprising highly neutralized polymer and an outer core comprising rubber;

a cover layer that comprises thermoplastic polyurethane surrounding the core, the cover layer having a cover hardness; and a mantle layer that comprises thermoplastic polyurethane positioned between the core and the cover layer, the mantle layer having a mantle hardness, wherein the mantle layer has a mantle layer thickness and the cover layer has a cover layer thickness, and wherein the mantle layer thickness is at least 0.6 mm less than the cover layer thickness;

wherein the cover hardness is at least 6 Shore D units less than the mantle hardness;

wherein the golf ball has a total volume that is a combined volume of all of the layers of the golf ball, and wherein the mantle layer has a mantle volume that is the volume of only the mantle layer, and wherein the mantle volume is less than ten percent of the total volume.

2. The golf bail according to claim 1, wherein the mantle volume is about 9.8 percent of the total volume.

3. The golf ball according to claim 2, wherein the mantle layer thickness is about 0.8 mm.

4. The golf ball according to claim 1, wherein the mantle volume is about 6.8 percent of the total volume.

5. The golf ball according to claim 4, wherein the mantle layer thickness is about 0.6 mm.

6. The golf ball according to claim 1, wherein the mantle hardness is between about 62 and about 70 on the Shore D scale.

7. The golf ball according to claim 1, wherein the cover hardness is between about 45 and about 58 on the Shore D scale.

8. The golf ball according to claim 1, wherein the mantle hardness is between about 62 and about 70 on the Shore D scale, and wherein the cover hardness is between about 45 and about 58 on the Shore D scale.

* * * * *